United States Patent [19]

Goebel et al.

[11] 4,332,114

[45] Jun. 1, 1982

[54] COVER

[76] Inventors: Virgil E. Goebel, Hutchinson; Raymond R. Dreier, Glencoe, both of Minn.

[21] Appl. No.: 157,362

[22] Filed: Jun. 9, 1980

Related U.S. Application Data

[63] Continuation of Ser. No. 12,957, Feb. 16, 1979, abandoned.

[51] Int. Cl.[3] ..... A47B 47/04; A47H 33/00

[52] U.S. Cl. ..... 52/36; 52/208; 52/631

[58] Field of Search ..... 52/36, 631, 202, 208, 52/403; 428/122, 126, 130; 156/79

[56] References Cited

U.S. PATENT DOCUMENTS

| | | | |
|---|---|---|---|
| 1,133,106 | 3/1915 | Cuppett | 52/631 |
| 2,066,813 | 1/1937 | Williams | 52/363 |
| 2,149,882 | 3/1939 | Clements | 52/631 |
| 2,278,331 | 3/1942 | Meyercord | 52/403 |
| 2,370,052 | 2/1945 | Lindelow | 52/361 |
| 2,867,864 | 1/1959 | Githens | 52/631 |
| 2,890,731 | 6/1959 | Maffei | 52/631 |
| 2,992,668 | 7/1961 | Collard | 150/52 R |
| 3,002,236 | 10/1961 | Humphner | 160/354 |
| 3,068,490 | 12/1962 | Pokras | 150/52 R |
| 3,256,663 | 6/1966 | Bishop | 52/288 |
| 3,446,340 | 5/1969 | Mullen | 52/403 |
| 3,494,308 | 2/1970 | Perrin | 108/150 |
| 3,649,398 | 3/1972 | Keith | 428/122 |
| 3,969,868 | 7/1976 | Bainter et al. | 52/631 |

FOREIGN PATENT DOCUMENTS

| | | | |
|---|---|---|---|
| 690554 | 7/1964 | Canada | 52/288 |

*Primary Examiner*—James L. Ridgill, Jr.
*Attorney, Agent, or Firm*—Thomas A. Lennon

[57] ABSTRACT

A heat conserving cover for a wall mounted air conditioning unit which comes in a knocked down condition and is capable of being readily assembled by the user at the point of installation into a tray or box shaped cover having a front wall and four side walls which are adapted to completely enclose the portion of the air conditioner extending into the room and adapted to abut with the wall structure supporting said air conditioner to provide an airtight seal therewith. The cover is composed of wall structure which has insulation throughout and an ornamental exterior so that it has the appearance of a piece of furniture, lending to the attractiveness of the cover in the room.

28 Claims, 9 Drawing Figures

COVER

This is a continuation of application Ser. No. 12,957, filed Feb. 16, 1979, now abandoned.

Wall mounted air conditioning units have been a rather commonplace commodity of commerce for a number of years. Some of these air conditioning units are permanently installed in an opening in the wall and others are permanently or semi-permanently installed in a window opening with the window partly raised. In any event, these air conditioners communicate with both the exterior atmosphere and the interior of the room or building that they are designed to cool. To function properly, they must be able to communicate with both the building air and discharge it outwardly to the surrounding atmosphere while sending cool air into the room.

In colder climates, when the temperature drops below the air conditioning level, either the air conditioner must be dismounted and the opening covered up or the window closed, or it must be permitted to remain in place with some type of covering to prevent the cold air from getting into the building and coversely to prevent the warm from escaping to the surrounding atmosphere. In many of these installations, it is difficult or impossible to successfully prevent heat loss from the outside. Examples are air conditioners which are supported exteriorly by wood or metal braces on the outside of the building, and air conditioners installed in multi-storied buildings where access to the exterior is difficult or impossible by the average owner.

To date, there has not been a truly successful cover for air conditioners which are left in place during the cold weather. The most commonly used expedient has been the use of some type of collapsable plastic garbage bag which is fitted around either the inside part of the air conditioner or the exterior part or both. However, these makeshift type of covers do not successfully insulate the building from the outside cold, and permit the cold air to enter and the warm air to escape which is obviously undesirable. Furthermore, these plastic bags are rather unattractive and unsightly and detract from the room decor if installed inside. If used outside, they tend to blow away in the wind or get torn or damaged by the wind and rain and sleet. Because of the lack of availability of suitable heat conserving means for air conditioners, many are removed by the owners at considerable inconvenience and expense, even though the owner would rather leave it installed if he could prevent heat from escaping and cold from entering the room.

The ability to conserve heat is especially important in these days of energy shortages where the availability of fuel is progressively diminishing and the cost of said fuel is constantly increasing.

It is the primary object of this invention to provide a new, novel and relatively inexpensive and attractive cover for a wall mounted air conditioning unit which will keep the cold air out and the warm air in thereby conserving heat and energy and making the room more comfortable and which will be attractive enough so that it not only does not detract from the decor, but in fact, enhances it.

Another object of this invention is to provide a cover for wall mounted air conditioners which is relatively inexpensive to construct and which is easy and inexpensive to install by the user, and which does not require any professional installer and which is of unitary construction and constructed in an unfolded, knocked down form which substantially reduces the cost of transportation and handling but which enables the user quickly to assemble and install same.

Still another object is to provide a readily installable, inexpensive air conditioner cover which can be used in virtually every type of building in which air conditioners are usually installed, including homes, apartments, motels and commercial and industrial buildings.

Still another object is to provide an air conditioner cover which not only prevents heat loss through the unit itself, but also prevents heat loss from around the unit between the unit and the building.

Another object is to provide an air conditioner cover which insulates as well as providing an air tight seal.

Other objects and advantages will be apparent from the following description and drawings in which.

Figure 1:
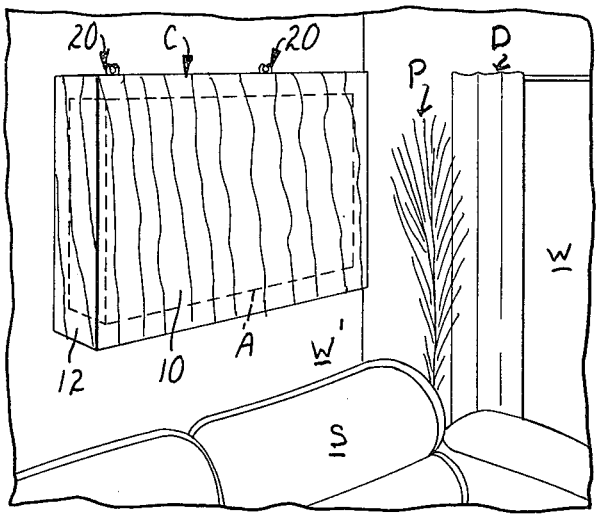
FIG. 1 is a perspective view of a wall mounted air conditioning unit enclosed by a cover of this invention.

Referring to the drawings, and particularly to FIG. 1, a cover C of this invention is shown enclosing an air conditioner A shown in dotted outline underneath the cover C, the air conditioner A being shown mounted on a wall $W^1$ forming part of a living room which includes a sofa S, a plant P and a window W covered by a drape D. The cover C as seen in FIG. 1 is flush with the surface of wall $W^1$ to seal the air conditioner A and prevent cold air from entering the room and warm air from escaping.

Figure 2:
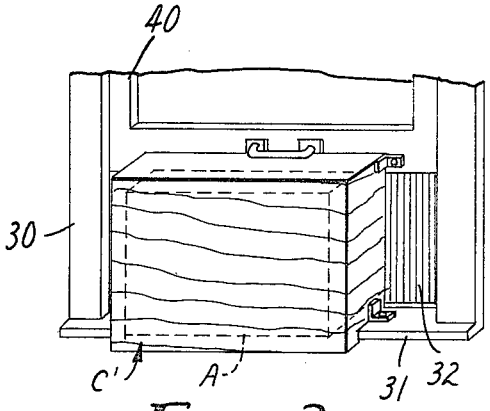
FIG. 2 is a perspective view of another use for the cover of FIG. 1.
Figure 3:
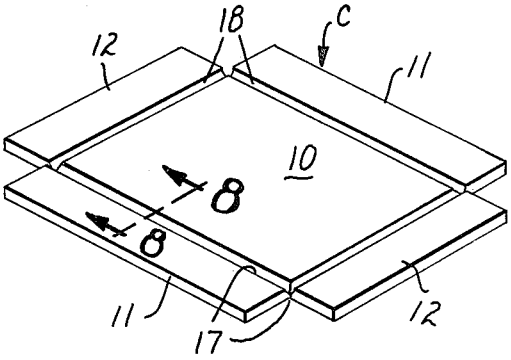
FIG. 3 is a perspective view of a cover of this invention in an unfolded shipping condition prior to assembly.

The cover C itself as shown in FIG. 3 in its unitary knocked down, unfolded shipping condition, consists of a main front wall 10, identical top and bottom walls 11 and identical end walls 12. As shown in the cross-sectional view of FIG. 5 each of the wall sections 10, 11 and 12 includes a core 13 of insulating material such as a styrofoam or poly-styrene type material, which styrofoam is sandwiched between two rigid walls 14 and 15 which are identical in nature and construction, the wall 14 facing outwardly and wall 15 facing inwardly. Wall 14 is in turn covered by a thin wood grain vinyl 16 which is decorative in nature and at the same time serves to hold the walls 11 and 12 to the main wall 10 along suitable fold lines 17 around the perimeter of wall 10. The vinyl 16 is of sufficient flexibility to permit it to function as a fold line or joint between the contiguous edges of the respective wall parts. Thus, the single sheet of vinyl 16 holds each of the sections 11 and 12 to section 10 and also provides the flexible joint therebetween so that they can be folded from the knocked down, unassembled flat condition of FIG. 3 to the assembled condition of FIGS. 1, 2, 4 and 5. The opposing edges of the wall portions 10, 11 and 12 are provided with tapered mitered edges 18 that permit their engaging one another when the cover is assembled as shown in FIG. 5 to form a right angle between adjacent wall sections. A foam weather strip seal 19 is also provided which is interposed between the leading edge 11*a* and 12*a* of each of the side walls of the cover and the wall W to provide an airtight seal. The weatherstripping is secured to the cover C by any suitable means, preferably some type of pressure sensitive adhesive.

Figure 4:
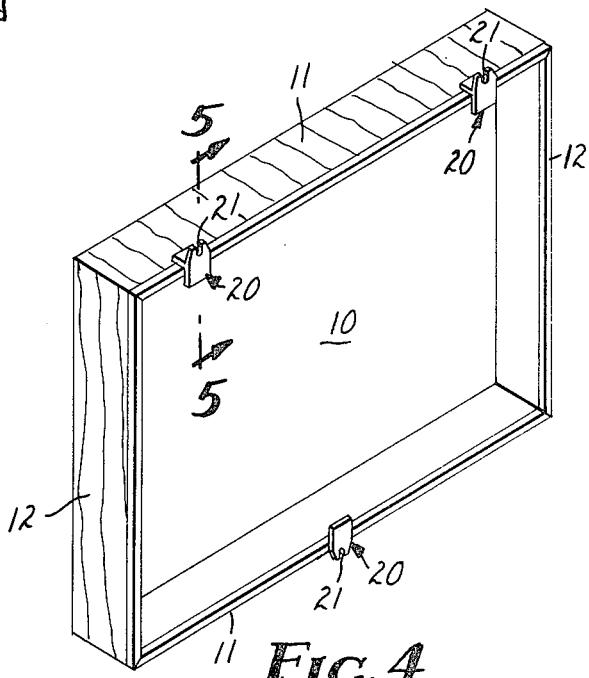
FIG. 4 is a perspective view of a cover of this invention in assembled condition prior to be installed in covering relationship on an air conditioner.
Figure 5:
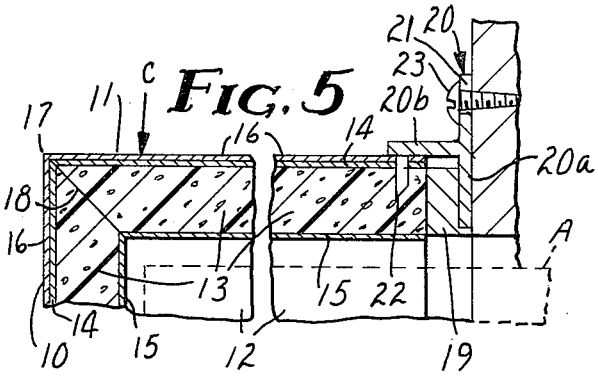
FIG. 5 is a cross-sectional view on an enlarged scale through the wall structure of the cover, said cross-section being taken on the line 5—5 of FIG. 4.
Figure 8:
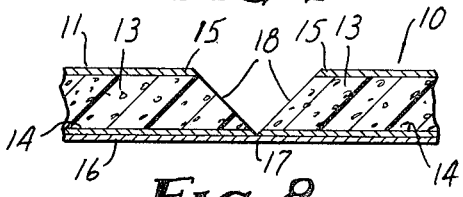
FIG. 8 is a cross-sectional view on an enlarged scale through a portion of the cover in its knocked down condition taken along the line 8—8 of FIG. 3.

Thus, the user simply takes the unfolded cover as it appears in FIG. 3 out of its container in his home and proceeds to fold up the sides of the condition shown in FIG. 4 and secures the abutting tapered ends 18*a* of sections 11 and 12 together by means of any suitable adhesive applied thereto so that the cover is glued together at the corners.

Once the user has assembled the cover, he simply mounts it over the air conditioner and molding so that the weather stripping seal engages the wall around the entire perimeter of the air conditioner As can be seen, it encloses the entire front as well as the molding around the air conditioner. Polystyrene foam insulation material keeps warm air in and cold air out. The grain vinyl cover 16 blends attractively with any decor and gives the appearance of another piece of furniture in the room. Because of the rigid, sturdy character of the supporting wall structure 14 and 15, the user can, if he desires, mount plaques or pictures on wall 10 of the cover.

Figure 6:
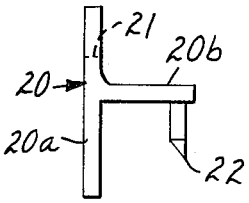
FIG. 6 is a side elevational view of a mounting clip for the cover of FIG. 1.
Figure 7:
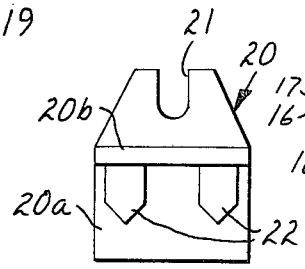
FIG. 7 is a front elevational view of the clip of FIG. 6.

FIGS. 6 and 7 illustrate a clip 20 which is especially suitable for mounting the cover of this invention. Said clip includes a wall engaging part 20*a* having a fastener receiving slot 21 formed in one end thereof. The clip also includes a cover engaging part 20*b* disposed at right angles to part 20*a*, said part 20*b* having a pair of cover engaging points 22 extending therefrom. The clips are mounted on the cover by manually pressing the parts 22 into the cover until part 20*b* rests against the cover, and the clip is then secured to the wall by any suitable fastener 23. One or more clips may be used as dictated by the particular circumstances.

FIG. 2 illustrates another application for the cover of this invention, in which the cover C′ is used to cover an air conditioner mounted in the window frame 30 of a window 40. The window is typically raised and the air conditioner is installed in the opening beneath the window and rests on the window sill 31 with an insert 32 being installed between the side of the air conditioner and the window frame to enclose the open space not occupied by the air conditioner. In this situation, clips 20 are used to secure the cover C′ to both the window and the sill as illustrated.

The cover insulates as well as seals tightly against the wall or window structure, so that there is no heat loss either through or around the air conditioner. When warm weather returns, the cover can be easily removed and stored until cold weather returns. The cover is durable enough to last many seasons and more likely than not for the life of the air conditioner. Thus, it is an ideal cover up and sealing system for an air conditioner.

Thus, it will be appreciated that in view of the great number of wall mounted air conditioners which presently exist and others which are to be installed in the future, the cover of this invention has a potential utility in the millions. Its use in large numbers will realize a collectively enormous saving in heat, which is extremely important in these days of energy shortages, which are not likely to soon abate. These covers eliminate the need to remove the air conditioner in the off season, and provide an attractive wall ornament or piece of furniture to the interior. If the user chooses, he can decorate the cover by hanging artifacts thereon. He can even paint or paper it the same color as the rest of the wall so that it blends right in with the decor, if he so desires. If, for any reason, the air conditioner has to be removed anyway, the cover provides an attractive and weather sealing cover-up for the opening.

The design results in a very light-weight cover, which minimizes the amount of fastening needed to hold it in place, so that a lot of mounting elements or clips don't have to be used, and it can be easily lifted and handled, even by the old and infirm.

Although this cover is intended primarily for interior use, it is apparent that the basic concept could be applied to a cover for the outside of the building in those situations where it would be reasonably convenient to mount one exteriorly.

The use of this cover also enables the air conditioner to remain mounted in those situations where the owner might have a space problem insofar as storing the air conditioner elsewhere, not to mention the saving in labor and the elimination of the inconvenience associated with putting it in and taking it out.

This cover has many unique qualities. It is the first to have a rigid construction which maintains a predetermined shape during use. It is the first which provides a substantially air tight seal with the supporting wall structure to prevent heat loss between the air conditioner and the building. It is the first to have insulated wall or panel construction which prevents heat loss through the air conditioner itself. It is also impervious to air, which makes it weathertight and draft free. It is the first to be of the foldable, put-it-together-yourself kind which can be shipped flat and knocked down to minimize shipping and handling costs, and yet which the user can quickly assemble and install in a matter of minutes.

It will also be understood that the thickness of the cover can be easily shortened if desired by simply cutting off a portion of the side panels 11 and 12, the materials used permitting easy sawing or cutting with a sharp instrument.

Although the cover has been intended for use with air conditioners, it will be appreciated that it can be used as a cover for other things mounted on a wall, or to cover openings used for something other than an air conditioner.

Unless some cutting down is to be done, no special tools are required to assemble and mount the cover, except perhaps a screw driver to install a screw in the wall to hold the mounting clip. The sides of the cover are simply glued at the corners, and the clips themselves are simply pushed into the cover in the same manner as a thumb tack would.

It will be noted that in the illustrated version the mounting clips are installed outside the weatherstripping. However, the weatherstripping is preferably sufficiently resilient or spongy to enable it to enclose the clip so that the weatherstripping is in maximum sealing engagement with the supporting wall.

It will also be appreciated that in some situations the weatherstripping will engage the molding or the window frame, rather than the supporting wall.

Figure 9:
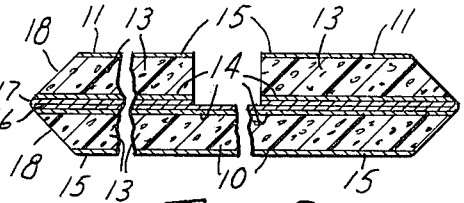
FIG. 9 is a cross sectional view through the cover in a folded transport condition.

Another important feature of the cover of this invention is illustrated in FIG. 9, which shows the cover in a folded condition suitable for packing and shipping. The longer top and bottom walls 11 are folded back upon the front face of the middle wall 10, which folding back is made possible by the flexible joint provided by the sheet of vinyl wood grain covering 16. This substantially reduces the overall width of the cover, thereby taking up less space width wise and providing a narrower package for shipment and storage, which can save considerably on shipping and handling costs, and can also provide a package which is easier to store.

In some situations the manufacturer may prefer to reduce the size of the package in the lengthwise direction, so as to make it shorter rather than narrower. In such case, the shorter end walls 12 would be folded back on center wall section 10 instead of the top and bottom walls 11.

It will be noted that the internal edges of the wall sections are mitered at a 45° angle so that when they are folded together in opposition to one another they form a 90° right angle for the cover.

The various wall sections 10, 11 and 12 are preferable of the same identical construction and thickness, except for their outside dimensions, for economy and convenience in manufacture.

The basic wall structure can be made all at once in single large sheets, panels, or sections which can then be cut to the desired size for the various parts.

The walnut wood graining on the vinyl sheets provides a design or impression of natural wood and enables the cover to take on the appearance of another piece of furniture in the room, adding to its attractive decor.

Where the moldings or trim prevent a tight seal, the user applies a double thickness of weatherstripping, one on top of the other, to overcome any irregularties.

The thin sheets or panels 14 and 15 which form the wall "sandwich" and hold the insulation therebetween can be formed of material presently sold under the trademark GATOR-PLY, which are cold pressed sheets of man-made wood fiber veneers that are impregnated with an acrylic-melamine fortified high load resin system.

It will, of course, be understood that various changes may be made in the various parts and dimensions referred to and illustrated herein without departing from the scope of this invention. The particular embodiments of the present invention which have been illustrated and discussed herein are for illustrative purposes only and are not to be considered as a limitation upon the scope of the appended claims. In these claims, it is my intent to claim the entire invention disclosed herein, except as I am limited by the prior art.

I claim:

1. A cover for wall mounted air conditioners and the like comprising first wall means, said first wall means having a peripheral edge, and second wall means attached to said first wall means adjacent said peripheral edge and extending therefrom in non-parallel relationship therewith, and wherein said first wall means is a first wall unit rectangular in plan view, said second wall means comprising a second wall unit connected with each edge of said first wall unit, said second wall units also being rectangular in plan view, each of said wall units comprising spaced apart wall panels, insulating material between said wall panels, a sheet of flexible material attached to one side of said first and second wall units and forming a flexible joint therebetween, said second wall units being adapted to move relative to said first wall unit from a co-planar position therewith to a substantially perpendicular position with respect thereto, means for holding said second wall units in said perpendicular position, and wherein the contiguous ends of said second wall units mate together in a mitered joint and adhesive means are applied to the mitered surfaces to hold said second wall units against movement, and including weatherstripping applied to the outer peripheral edges of said second wall units, and wherein said flexible sheet is a plastic material having a wood grain appearance, and including a clip for mounting said cover on supporting structure, said clip including pointed means for penetrating said wall means and thereby fastening said clip to said wall means, said clip also including an opening for receiving a fastener adapted to fasten said clip to said supporting structure, and wherein said clip includes a first body portion adapted to be placed against said supporting structure, said opening comprising a slot extending inwardly from an edge of said first body portion, a second body portion extending from said first body portion at substantially right angles thereto, said pointed means extending at substantially right angles to said second body portion and substantially parallel to said first body portion, and wherein said pointed means comprising a pair of elements which have pointed distal ends and which are substantially semi-circular in cross-section, and wherein said wall panels are formed of wood, and wherein said insulating means is a styrofoam material, and wherein said flexible material is vinyl, and wherein said weather stripping means is an elongate strip attached to the exterior peripheral edge of said second wall means and effectively forming an extension thereof, said strip being adapted to directly engage a wall surface and seal the interior of said cover, and wherein said weather stripping is a resilient foam material.

2. A cover for wall mounted air conditioners and the like comprising first wall means, said first wall means having a peripheral edge, and second wall means attached to said first wall means adjacent said peripheral edge and extending therefrom in non-parallel relationship therewith, and wherein said first wall means is a first wall unit rectangular in plan view, said second wall means comprising a second wall unit connected with each edge of said first wall unit, said second wall units also being rectangular in plan view, each of said wall units comprising spaced apart wall panels, insulating material between said wall panels,
a sheet of flexible material attached to one side of said first and second wall units and forming a flexible joint therebetween,
said second wall units being adapted to move relative to said first wall unit from a co-planar position therewith to a substantially perpendicular position with respect thereto, and
means for holding said second wall units in said perpendicular position, and
wherein the contiguous ends of said second wall units mate together in a mitered joint and adhesive means are applied to the mitered surfaces to hold said second wall units against movement, and
including weather stripping applied to the outer peripheral edges of said second wall units, and
wherein said flexible sheet is a plastic material having a wood grain appearance, and
wherein said wall panels are formed of wood, and
wherein said insulating means is a styrofoam material, and
wherein said flexible material is vinyl, and wherein said weather stripping means is an elongate strip attached to the exterior peripheral edge of said second wall means and effectively forming an extension thereof, said strip being adapted to directly engage a wall surface and seal the interior of said cover, and
wherein said weather stripping is a resilient foam material.

3. A cover for wall mounted air conditioners and the like comprising first wall means,
said first wall means having a peripheral edge,
and second wall means attached to said first wall means adjacent said peripheral edge and extending therefrom in non-parallel relationship therewith, and
said first wall means is a first wall unit rectangular in plan view,
said second wall means comprising a second wall unit connected with each edge of said first wall unit,
said second wall units also being rectangular in plan view,
each of said wall units comprising spaced apart wall panels,
insulating material between said wall panels,
a sheet of flexible material attached to one side of said first and second wall units and forming a flexible joint therebetween,
said second wall units being adapted to move relative to said first wall unit from a co-planar position therewith to a substantially perpendicular position with respect thereto, and
means for holding said second wall units in said perpendicular position,
and wherein the contiguous ends of said second wall units mate together in a mitered joint and adhesive means are applied to the mitered surfaces to hold said second wall units against movement,
and including weather stripping applied to the outer peripheral edges of said second wall units,
and wherein said flexible sheet is a plastic material having a wood grain appearance, and
wherein said wall panels are formed of wood, and
wherein said insulating means is a styrofoam material, and
wherein said weather stripping is a resilient foam material.

4. A cover for wall mounted air conditioners and the like comprising first wall means,
said first wall means having a peripheral edge,
and second wall means attached to said first wall means adjacent said peripheral edge and extending therefrom in non-parallel relationship therewith, and
wherein said first wall means is a first wall unit rectangular in plan view,
said second wall means comprising a second wall unit connected with each edge of said first wall unit,
said second wall units also being rectangular in plan view,
each of said wall units comprising spaced apart wall panels,
insulating material between said wall panels,
a sheet of flexible material attached to one side of said first and second wall units and forming a flexible joint therebetween,
said second wall units being adapted to move relative to said first wall unit from a co-planar position therewith to a substantially perpendicular position with respect thereto, and
means for holding said second wall units in said perpendicular position,
and wherein the contiguous ends of said second wall units mate together in a mitered joint and adhesive means are applied to the mitered surfaces to hold said second wall units against movement,
and including weather stripping applied to the outer peripheral edges of said second wall units,
and wherein said flexible sheet is a plastic material having a wood grain appearance,
wherein said wall panels are formed of wood, and wherein said weather stripping is a resilient foam material.

5. A cover for wall mounted air conditioners and the like comprising first wall means,
said first wall means having a peripheral edge,
and second wall means attached to said first wall means adjacent said peripheral edge and extending therefrom in non-parallel relationship therewith, and
wherein said first wall means is a first wall unit rectangular in plan view,
said second wall means comprising a second wall unit connected with each edge of said first wall unit,
said second wall units also being rectangular in plan view,
each of said wall units comprising spaced apart wall panels,
insulating material between said wall panels,
a sheet of flexible material attached to one side of said and second wall units and forming a flexible joint therebetween,
said second wall units being adapted to move relative to said first wall unit from a co-planar position therewith to a substantially perpendicular position with respect thereto, and
means for holding said second wall units in said perpendicular position,
and including weather stripping applied to the outer peripheral edges of said second wall units,
wherein said wall panels are formed of wood, and
wherein said flexible material is vinyl, and
wherein said weather stripping is a resilient foam material.

6. A cover for wall mounted air conditioners and the like comprising first wall means, said first wall means having a peripheral edge, and second wall means attached to said first wall means adjacent said peripheral edge and extending therefrom in non-parallel relationship therewith, and wherein said first wall means is a first wall unit rectangular in plan view, said second wall means comprising a second wall unit connected with each edge of said first wall unit, said second wall units also being rectangular in plan view, each of said wall units comprising spaced apart wall panels, insulating material between said wall panels, a sheet of flexible material attached to one side of said first and second wall units and forming a flexible joint therebetween, said second wall units being adapted to move relative to said first wall unit from a co-planar position therewith to a substantially perpendicular position with respect thereto, and means for holding said second wall units in said perpendicular position, and including weather stripping applied to the outer peripheral edges of said second wall units, and wherein said flexible sheet is a plastic material, wherein said wall panels are formed of wood, wherein said insulating means is a styrofoam material.

7. A cover for wall mounted air conditioners and the like comprising first wall means, said first wall means having a peripheral edge, and second wall means attached to said first wall means adjacent said peripheral edge and extending therefrom in non-parallel relationship therewith, and wherein said wall means include opposing spaced apart wall panels, and wherein said wall panels are rigid, and including a sheet of flexible material attached to adjacent rigid panels of said first and second wall means and overlying the adjacent edges thereof and forming a flexible joint between the adjacent first and second wall means so that they are movable relative to one another with said flexible material serving as a hinge connection therebetween.

8. The cover of claim 7, wherein said wall panels are made of wood, and including insulating means interposed between said wall panels.

9. The cover of claim 7, wherein said wall panels are wood and including foam insulating material interposed between said wall panels.

10. The cover of claim 7, wherein said flexible material has a wood grain appearance.

11. The cover of claim 7, including weather stripping applied to the outer peripheral edges of said second wall units.

12. The cover of claim 11, wherein said weather stripping is secured to said panels by pressure sensitive adhesive.

13. The cover of claim 7, wherein said flexible material is plastic.

14. The cover of claim 13, wherein said flexible material has a wood grain appearance.

15. The cover of claim 13, including insulating means interposed between said wall panels.

16. The cover of claim 13, wherein said plastic is vinyl.

17. The cover of claim 7, including insulating means interposed between said wall panels.

18. The cover of claim 17, wherein said flexible material has a wood grain appearance.

19. The cover of claim 17, wherein said flexible material is plastic and presents a wood grain appearance.

20. The cover of claim 17, wherein said insulating means is a non-gaseous material.

21. The cover of claim 17, wherein said insulating means is a foam material.

22. The cover of claim 17, wherein said insulating means is styrofoam material.

23. The cover of claim 7, wherein said wall panels are made of wood.

24. The cover of claim 23, wherein said flexible material presents a wood grain appearance.

25. The cover of claim 23, wherein said wood panels are cold pressed sheets of man-made wood fiber veneers impregnated with an acrylic fortified high load resin system.

26. The cover of claim 23, wherein said flexible material is plastic.

27. The cover of claim 26, wherein said flexible material presents a wood grain appearance.

28. The cover of claim 27, including insulating means interposed between said wall panels.

* * * * *